US006264253B1

(12) United States Patent
Takaishi

(10) Patent No.: US 6,264,253 B1
(45) **Date of Patent: *Jul. 24, 2001**

(54) DOOR LOCK APPARATUS PROVIDED WITH A SENSING SWITCH

(75) Inventor: Tatsuyuki Takaishi, Kanagawa (JP)

(73) Assignee: Ohi Seisakusho Co., Ltd., Yokohama (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/141,724

(22) Filed: Aug. 27, 1998

(30) Foreign Application Priority Data

Aug. 27, 1997 (JP) ..... 9-230617

(51) Int. Cl.[7] ..... E05C 3/06; E05C 3/16
(52) U.S. Cl. ..... 292/216; 292/201
(58) Field of Search ..... 292/201, 216

(56) References Cited

U.S. PATENT DOCUMENTS 3,857,001 * 12/1974 Quantz ..... 200/61.64
4,298,223 * 11/1981 Raffelsiefer et al. ..... 292/216
4,593,945 * 6/1986 Arute et al. ..... 292/201
4,806,712 * 2/1989 Hoffman et al. ..... 200/61.62
5,137,311 * 8/1992 Brackmann ..... 292/216
5,722,706 * 3/1998 Bartel et al. ..... 292/216

FOREIGN PATENT DOCUMENTS 61-49471 6/1981 (JP) .

* cited by examiner

*Primary Examiner*—Lynne H. Browne
*Assistant Examiner*—John B. Walsh
(74) *Attorney, Agent, or Firm*—Foley & Lardner

(57) ABSTRACT

In a door lock apparatus having an engagement mechanism that can rotate between an open position corresponding to an open position of a door and a full latch position corresponding to a door closed position as the door is opened and closed, the engagement mechanism being housed in a housing section of a body, and a sensing switch having an actuator coming in sliding contact with a cam face of the engagement mechanism and pushed to an actuation position following rotation of the engagement mechanism for sensing a door open or closed state, a switch attachment section having a through hole for allowing the outside and the housing section to communicate with each other is formed in the body, a switch case housing the sensing switch is fixed to the switch attachment section, and the actuator of the sensing switch can come in sliding contact with the cam face of the engagement mechanism through the through hole.

14 Claims, 5 Drawing Sheets

DOOR LOCK APPARATUS PROVIDED WITH A SENSING SWITCH

BACKGROUND OF THE INVENTION

1. Field of the Invention

This invention relates to a door lock apparatus provided with a sensing switch for sensing a door open/closed state by detecting a rotation position of an engagement mechanism of a door lock, especially used for automobile.

2. Description of the Related Art

For example, Japanese Patent Publication No. Sho. 61-49471 discloses an automobile door lock apparatus provided with a sensing switch for sensing a door open/closed state in a conventional art. The door lock apparatus comprises a latch that can be engaged into and disengaged from a striker fixed to the car body side as the door is opened and closed, a pole that can be engaged into and disengaged from the latch, the latch and the pole constituting an engagement mechanism, and a sensing switch for sensing a latch position changing in response to a door open/closed state, thereby sensing the door open/closed state, the members being housed in a housing section of a body of the door lock apparatus.

However, with the door lock apparatus as aforementioned, the sensing switch together with the engagement mechanism is fitted into the housing section of the body, thus a space for housing the sensing switch needs to be reserved in the body and the attachment face of the body increases. Since a harness is connected to the sensing switch, the door lock apparatus must be fitted while the harness is being trailed; a problem of a poor fit is involved. Further, it is feared that rainwater, etc., entering the body may cause an operation failure of the sensing switch.

It is therefore a first object of the invention to provide a door lock apparatus provided with a sensing switch intended for suppressing upsizing of a body attachment face and improving a fit of the door lock apparatus.

It is a second object of the invention to provide a door lock apparatus provided with a sensing switch designed for preventing rainwater, etc., entering a door lock main body from causing an operation failure of a sensing switch.

According to the invention, the problems are solved as follows:

(1) In a door lock apparatus comprising an engagement mechanism that can rotate between an open position corresponding to an open position of a door and a full latch position corresponding to a door closed position as the door is opened and closed, the engagement mechanism being housed in a housing section of a body, and a sensing switch having an actuator coming in sliding contact with a cam face of the engagement mechanism and pushed to an actuation position following rotation of the engagement mechanism for sensing a door open or closed state, a switch attachment section having a through hole for allowing the outside and the housing section to communicate with each other is formed in the body, a switch case housing the sensing switch is fixed to the switch attachment section, and the actuator of the sensing switch can come in sliding contact with the cam face of the engagement mechanism through the through hole.

(2) In (1) above, the switch attachment section has a projection part formed in the upper end of the body and projecting upward from the surroundings of the through hole and the switch case covers the projection part and is fixed in a cap-like manner.

(3) In (1) or (2) above, the housing section of the body is provided with a cover part for covering the actuator of the sensing switch.

(4) In (1) or (3) above, the switch attachment section is formed on one side of the body and the actuator of the sensing switch is placed in the housing section of the body from the body side through the through hole.

(5) In any of (1) to (4) above, the cam face of the engagement mechanism is formed as a shape for causing the actuator of the sensing switch to be moved to the actuation position when the engagement mechanism is at the open position.

DETAILED DESCRIPTION OF THE PREFERRED EMBODIMENTS

Figure 1:
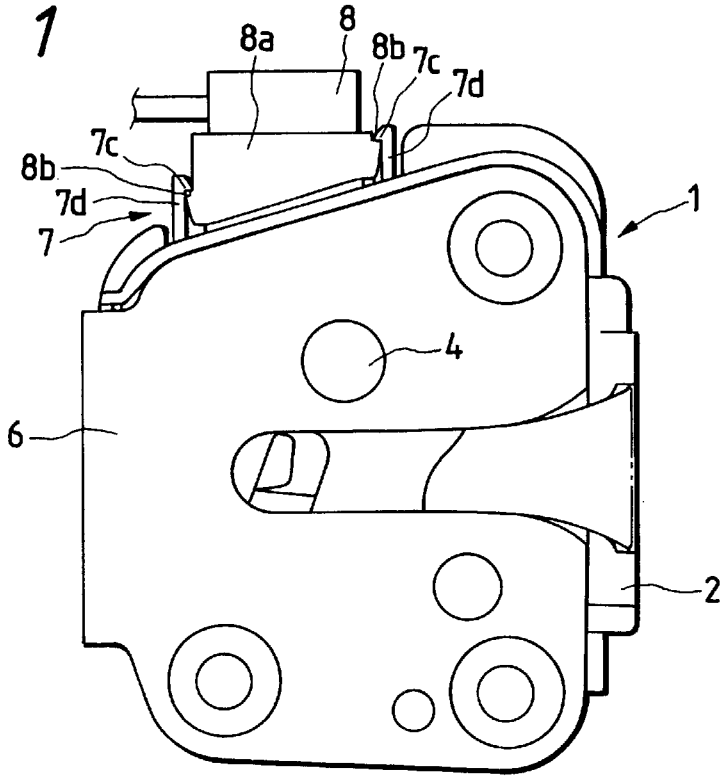
FIG. 1 is a front view of a door lock apparatus of a first embodiment of the invention.
Figure 2:
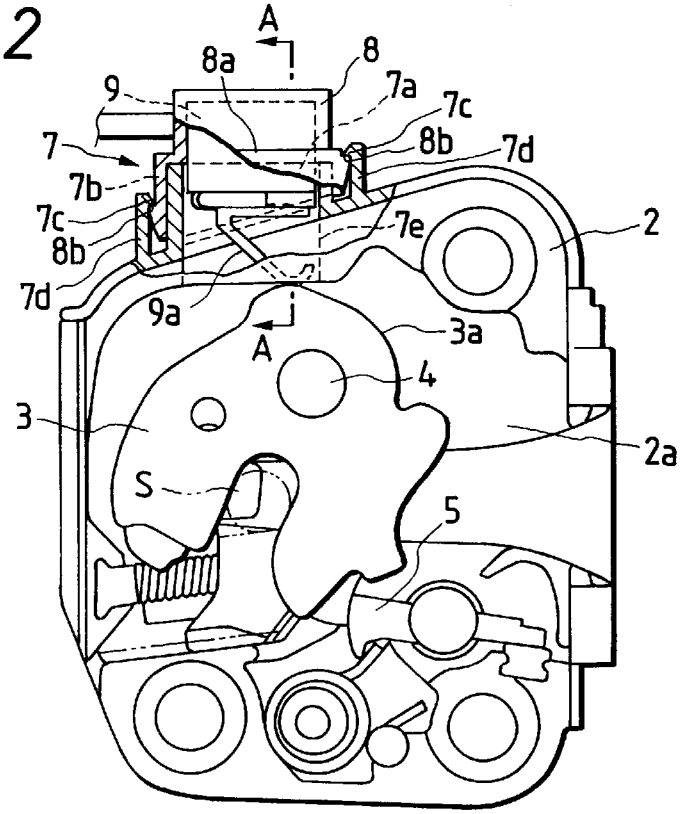
FIG. 2 is a partially cutaway front view of the door lock apparatus with a cover plate removed in FIG. 1.
Figure 3:
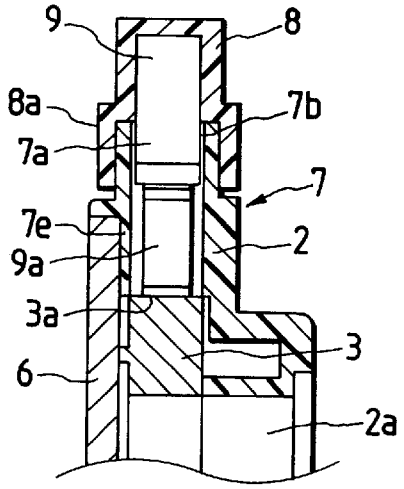
FIG. 3 is a sectional view taken along line A—A in FIG. 2.

FIG. 1 to FIG. 3 show a first embodiment of the invention. FIG. 1 is a front view of a door lock apparatus and FIG. 2 is a front view to show an internal structure of the door lock apparatus.

In the figures, numeral 1 is a door lock main body fixed to a door of an automobile, numeral 2 is a body molded of a synthetic resin material, numeral 3 is a latch which is pivotally supported on a shaft 4 in a housing section 2*a* of the body 2 for rotation and can be engaged into and disengaged from a striker S fixedly secured to the car body side, numeral 5 is a pole which is pivotally supported on the body 2 for rotation and can be engaged into and disengaged from the latch 3, and numeral 6 is a metal cover plate for blocking the housing section 2*a* of the body 2.

As shown in FIG. 2, the latch 3 can rotate between a full latch position at which it is engaged into the striker S for holding the door closed and an open position corresponding to a door open position at which the latch 3 rotates counterclockwise from the full latch position in FIG. 2 and is disengaged from the striker S; it is formed with a cam face 3*a* on the outer peripheral surface of the upper part. The latch 3 and the pole 5 make up an engagement mechanism.

The body 2 is formed on an upper wall integrally with a switch attachment section 7 having a through hole 7*a* for allowing the outside and the housing section 2*a* to communicate with each other, a projection part 7*b* projecting upward from the surroundings of the through hole 7*a*, and retention pieces 7*d* projecting upward from both sides of the projection part 7*b* and having inward hooks 7*c* at the upper ends, the retention pieces 7*d* being able to become elastically deformed to a side. A cover part 7*e* dangling downward continuously from the through hole 7*a* is formed at a position adjacent to the cover plate 6 in the upper part of the housing section 2*a* of the body 2.

Numeral 8 is a box-like switch case attached to the switch attachment section 7. The switch case 8 has a fit part 8*a* fitted into the projection part 7*b* of the switch attachment section 7 with no gap. The fit part 8*a* is formed on the outside with a step part 8*b* engaging the hook part 7*c* for preventing the switch case 8 from slipping out.

Numeral 9 is a sensing switch which is housed in and fixed to the switch case 8 and has electric contacts for sensing a position of the latch 3. The switch case 8 is fixed to the switch attachment section 7, whereby the sensing switch 9 is fixed to the switch attachment section 7 of the body 2. An actuator 9*a* of the sensing switch 9 faces the housing section 2*a* of the body 2 via the through hole 7*a* and is covered with the cover part 7*e* and fixed so as not to come in direct contact with the cover plate 6. The actuator 9*a* can come in sliding contact on the cam face 3*a* of the latch 3. When the latch 3 rotates to the full latch position, the actuator 9*a* is pushed up by the cam face 3*a* and movesto an actuation position, outputting a non-signal. When the latch 3 rotates to the open position, the actuator 9*a* is moved downward by a spring force contained in the sensing switch 9, outputting an off-signal.

After completion of fitting all of the latch 3, the pole 5, and other parts to the body 2 and fitting the door lock apparatus 1, the switch case 8 is attached to the switch attachment section 7 of the body 2 with the sensing switch 9 housed in and fixed to the switch case 8. Therefore, it is not necessary to fit the door lock apparatus 1 while trailing a harness of the sensing switch 9, and the sensing switch 9 can be easily attached to the body 2.

Since the sensing switch 9 is surrounded almost fully by the switch case 8, rainwater, etc., entering the door is not deposited on the sensing switch 9. Further, the actuator 9*a* of the sensing switch 9 is covered with the cover part 7*e*. Thus, if rainwater, etc., enters the gap between the body 2 and the cover plate 6, the cover part 7*e* prevents rainwater, etc., from being LE- deposited on the actuator 9*a*.

Figure 4:
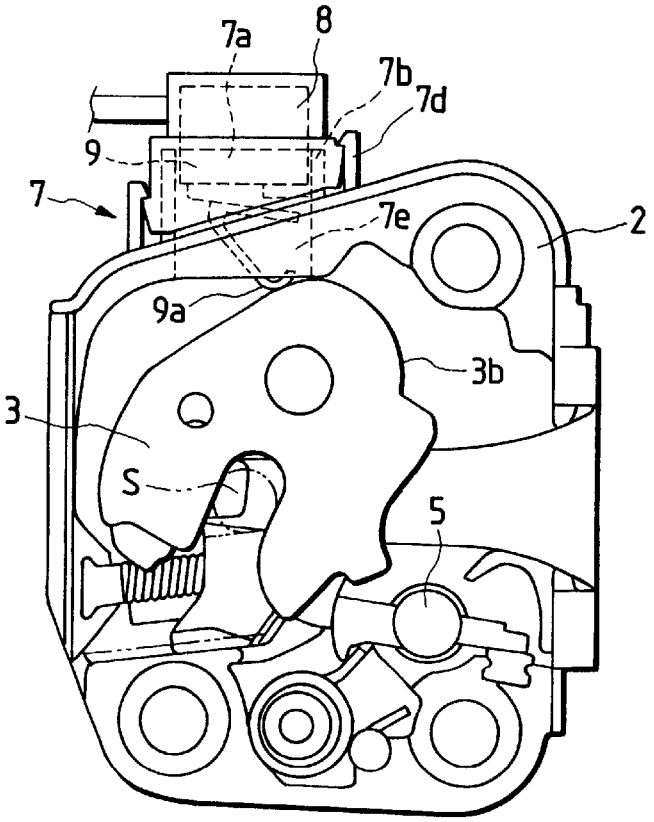
FIG. 4 is a front view similar to FIG. 2 in a second embodiment of the invention.

FIG. 4 shows a second embodiment of the invention. In the second embodiment, a cam face 3*b* of a latch 3 with which an actuator 9*a* of a sensing switch 9 comes in sliding contact is formed as such a cam shape causing the actuator 9*a* to be pushed down by a spring force when the latch 3 is at a full latch position and the actuator 9*a* to be pushed up against the spring force and positioned at an actuation position when the latch 3 is at an open position. The cam face 3*b* is thus formed, whereby even if the actuator 9*a* freezes with the door closed, as the latch 3 rotates to the open position, the cam face 3*a* can cause the actuator 9*a* to be forcibly thawed and moved to the actuation position; the subsequent smooth actuation is enabled. Other components, which are the same as those of the first embodiment, are simply shown and will not be discussed again in detail.

Figure 5:
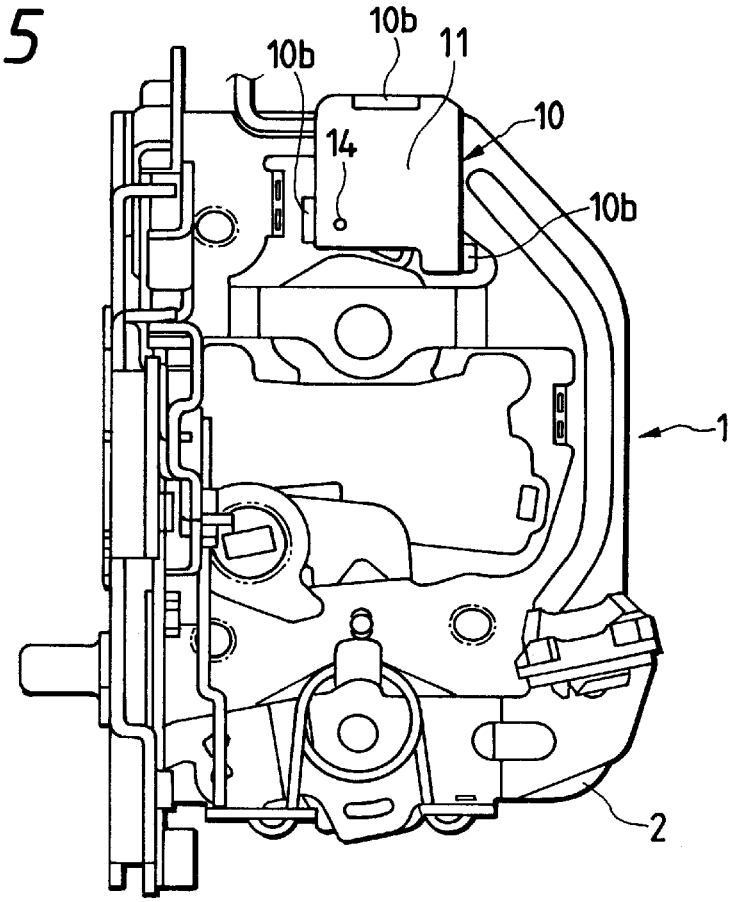
FIG. 5 is a rear view of a door lock apparatus of a third embodiment of the invention.
Figure 6:
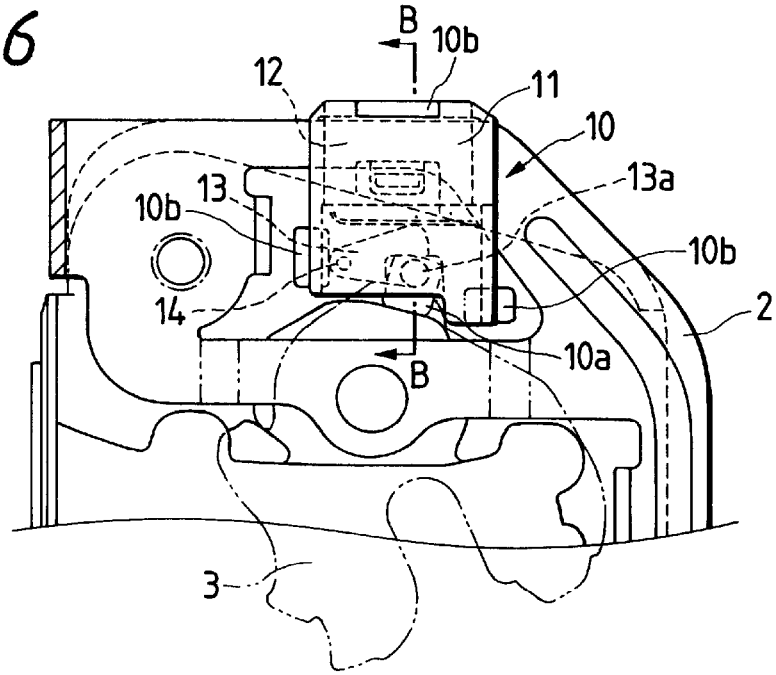
FIG. 6 is an enlarged rear view of a main part in FIG. 5.
Figure 7:
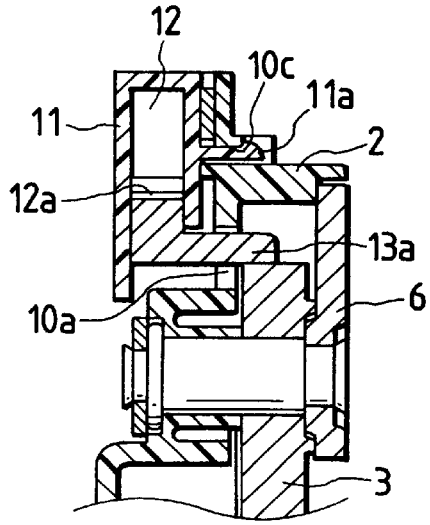
FIG. 7 is a sectional view taken along line B—B in FIG. 6.
Figure 8:
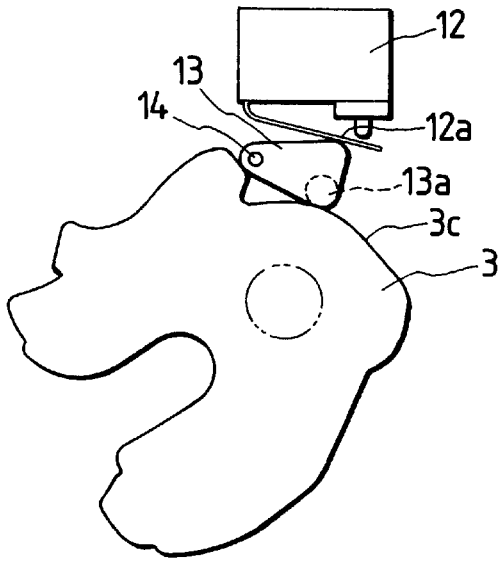
FIG. 8 is a schematic enlarged view of the main part of the third embodiment of the invention.
Figure 9:
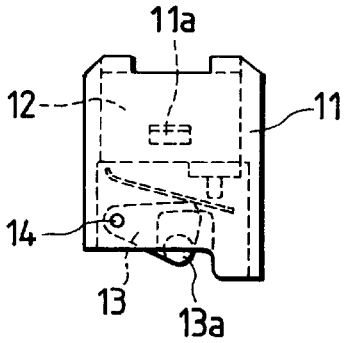
FIG. 9 is a rear view of a switch case in the third embodiment of the invention.
Figure 10:
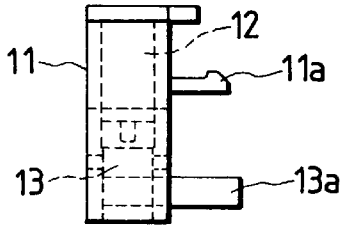
FIG. 10 is a side view of the switch case in the third embodiment of the invention.

FIG. 5 to FIG. 10 show a third embodiment of the invention. FIG. 5 is a rear view of a door lock apparatus. FIG. 6 is an enlarged rear view of a main part. FIG. 7 is a sectional view taken along line B—B in FIG. 6. FIG. 8 is a schematic enlarged view of only the main part. FIG. 9 and FIG. 10 are a rear view and a side view of a switch case.

In the figures, numeral 10 is a switch attachment section being formed in an upper part of a rear face of a side of the body 2 and having a through hole 10*a* penetrating the outside and a housing section 2*a* and a plurality of projection guide parts 10*b* projecting outward, numeral 11 is a switch case fixed to the switch attachment section 10, and numeral 12 is a sensing switch housed in and fixed to the switch case 11. Numeral 13 is a sensing plate being pivotally supported on a shaft 14 in the switch case 11 for swinging for actuating an actuator 12*a* of the sensing switch 12. The sensing plate 13 has at the tip a sensing part 13*a* that can rush into the housing section 2*a* of the body 2 through the through hole 10*a* and come in sliding contact with a cam face 3*c* of a latch 3.

The switch case 11 surrounds the sensing switch 12 and has a claw part 11*a* that can engage a retention hole 10*c* made in the body 2 on the face opposed to the body 2. It is sandwiched between guide parts 10*b* and the claw part 11*a* is engaged into the retention hole 10*c*, whereby the switch case 11 is fixed to the switch attachment section 10.

The latch 3 moves between a full latch position shown in FIG. 6 and an open position shown in FIG. 8, whereby the sensing plate 13 swings up and down following the cam face 3*c* of the latch 3 and actuates the actuator 12*a* of the sensing switch 12. Therefore, the actuator 12*a* comes in indirect contact with the cam face 3*c* via the sensing plate 13 and the sensing switch 12 can detect the position of the latch 3.

After completion of fitting all of the latch 3 and other parts to the body 2 and fitting the door lock apparatus 1, the switch case 11 housing the sensing switch 9 is fixed to the switch attachment section 10, as in the first embodiment. Other components, which are the same as those of the first embodiment, are simply shown and will not be discussed again in detail.

In the embodiment, the door lock apparatus 1 can be fitted without trailing a harness connected to the sensing switch 12 in the fitting line step, as in the first embodiment.

The sensing switch 12 is placed on the side of the body 2, so that the dimension of the top to bottom of the whole door lock apparatus 1 can be lessened.

Figure 11:
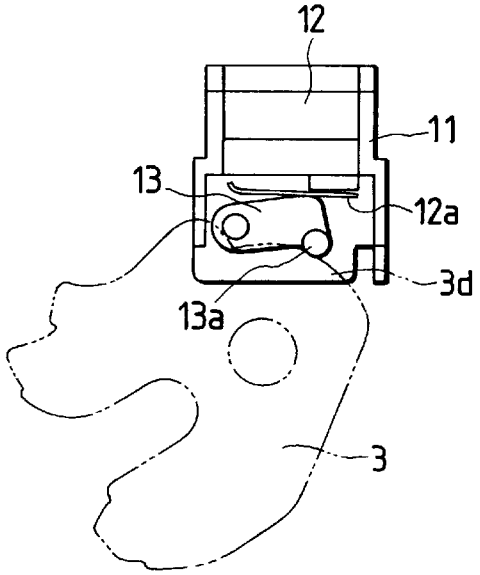
FIG. 11 is a schematic representation of a main part of a fourth embodiment of the invention.

FIG. 11 shows a fourth embodiment of the invention.

In the fourth embodiment, a cam face 3*d* of a latch 3 with which a sensing section 13*a* of a sensing plate 13 comes in sliding contact is formed as such a cam shape causing an actuator 12*a* to be moved down by a spring force when the latch 3 is at a full latch position and the actuator 12*a* to be pushed up through the sensing plate 13 and moved to an actuation position when the latch 3 is at an open position, as in the second embodiment. The cam face 3*d* is thus formed, whereby a similar advantage to that of the second embodiment can be offered in addition to the advantage of the third embodiment.

According to the invention, the following advantages are provided:

If the switch attachment section having the through hole for allowing the outside and the housing section to communicate with each other is formed in the body and the switch case housing the sensing switch is fixed to the switch attachment section and the actuator of the sensing switch can come in sliding contact with the cam face of the engagement mechanism through the through hole, a fit of the door lock apparatus can be improved and further the attachment face of the door lock main body can be lessened.

If the switch attachment section has a projection part formed in the upper end of the body and projecting upward from the surroundings of the through hole and the switch case covers the projection part and is fixed in a cap-like manner, the entry of rainwater, etc., can be prevented reliably.

If the housing section of the body is provided with a cover part for covering the actuator of the sensing switch, deposition of rainwater, etc., on the actuator of the sensing switch can be prevented.

If the switch attachment section is formed on one side of the body and the actuator of the sensing switch is placed in the housing section of the body from the body side through the through hole, the whole dimensions of the attachment face of the door lock apparatus can be reduced.

The cam face of the engagement mechanism is formed as a shape for causing the actuator of the sensing switch to be moved to the actuation position when the engagement mechanism is at the open position, whereby freezing in the door closed state can be prevented from causing a sensing switch operation failure.

What is claimed is:

1. A door lock apparatus comprising:

a main body including a switch attachment section, said switch attachment section having a through hole and a projection part;

an engagement mechanism housed in said main body and rotatable between an open position corresponding to a door open state and a full latch position corresponding to a door closed state, said engagement mechanism including a latch having a cam face;

a switch case having a fit part engageable with said projection part to create a connection therebetween that prevents passage of foreign material into the door lock apparatus through said through hole; and a sensing switch housed in said switch case, said sensing switch having an actuator that slidingly contacts said cam face of said latch of said engagement mechanism through said through hole and that is pushed to an actuation position following rotation of said engagement mechanism for sensing the door open state and the door closed state.

2. A door lock apparatus according to claim 1, wherein said projection part is formed in an upper wall of said main body and projects upward at a perimeter of said through hole, and said switch case covers said projection part and is fixed thereto.

3. The door lock apparatus according to claim 1, wherein said main body comprises a cover part that covers said actuator of said sensing switch.

4. The door lock apparatus according to claim 1, wherein said switch attachment section is formed on a side of said main body, and said actuator of said sensing switch is placed in said main body from said side of said main body through said through hole.

5. The door lock apparatus according to claim 1, wherein said cam face of said latch of said engagement mechanism is configured to move said actuator of said sensing switch to an actuation position when said engagement mechanism is at the open position.

6. A door lock apparatus comprising:

a main body including an upper wall and a switch attachment section, said switch attachment section having a through hole for allowing an outside and an inside thereof to communicate with each other;

an engagement mechanism being housed in said main body and rotating between an open position corresponding to a door open state and a full latch position corresponding to a door closed state;

a cover member mountable to said main body;

a switch case mountable to said switch attachment section of said main body after said cover member is mounted to said main body; and a sensing switch housed in said switch case, said sensing switch having an actuator that slidingly contacts said engagement mechanism through said through hole and that is pushed to an actuation position following rotation of said engagement mechanism for sensing the door open state and the door closed state.

7. The apparatus according to claim 1, wherein said fit part extends around a perimeter of said switch case, and said projection part extends around a perimeter of said through hole.

8. The apparatus according to claim 1, wherein said switch attachment section comprises at least one retention member projecting upward from at least one side of said switch attachment section, spaced from said projection part, and said fit part of said switch case is engaged between said projection part and said at least one retention member.

9. The apparatus according to claim 8, wherein said at least one retention member has at least one hook, and said switch case has at least one step to engage with said at least one hook.

10. The apparatus according to claim 8, wherein said at least one retention member is elastically deformable.

11. A door lock apparatus comprising:

a main body including a switch attachment section, said switch attachment section having a through hole and at least one retention hole therethrough;

an engagement mechanism housed in said main body and rotatable between an open position corresponding to a door open state and a full latch position corresponding to a door closed state, said engagement mechanism including a latch having a cam face;

a switch case having at least one claw part that is engageable with said at least one retention hole to mount said switch case to said switch attachment section; and a sensing switch housed in said switch case, said sensing switch having an actuator that slidingly contacts said cam face of said latch of said engagement mechanism through said through hole and that is pushed to an actuation position following rotation of said engagement mechanism for sensing the door open state and the door closed state.

12. A sensing switch and a structure for mounting said sensing switch on a door lock apparatus, comprising:

a switch attachment section formed in a main body housing an engagement mechanism of the door lock apparatus, said switch attachment section having a through hole and a projection part;

a switch case having a fit part engageable with said projection part to create a connection therebetween that prevents passage of foreign material into the door lock apparatus through said through hole; and a sensing switch housed in said switch case and being engageable with said switch attachment section, said sensing switch having an actuator;

wherein, when said switch case is fixed to said switch attachment section, said actuator of said sensing switch comes into sliding contact with a cam face of a latch of the engagement mechanism through said through hole.

13. The sensing switch and structure for mounting said sensing switch on a door lock apparatus according to claim 12, wherein said projection part is formed in an upper wall of the main body and projects upward at a perimeter of said through hole, and said switch case covering said projection part and being fixed thereto.

14. The sensing switch and structure for mounting said sensing switch on a door lock apparatus according to claim 12, wherein said switch attachment section includes a cover part that covers said actuator of said sensing switch.

* * * * *